United States Patent [19]

Smith et al.

[11] Patent Number: 4,465,120

[45] Date of Patent: Aug. 14, 1984

[54] INCLINED WHEEL AND BELT CASTING MACHINE

[75] Inventors: Michael C. Smith, LaGrange; Robert S. Linne, Carrollton, both of Ga.

[73] Assignee: Southwire Company, Carrollton, Ga.

[21] Appl. No.: 458,409

[22] Filed: Jan. 17, 1983

[51] Int. Cl.[3] ..... B22D 11/06

[52] U.S. Cl. ..... 164/482; 164/433

[58] Field of Search ..... 164/476, 429, 433, 434, 164/482

[56] References Cited

U.S. PATENT DOCUMENTS 3,318,367 5/1967 Bray ..... 164/433

3,478,810 11/1969 Carton ..... 164/482

*Primary Examiner*—Nicholas P. Godici

*Assistant Examiner*—P. Weston Musselman, Jr.

*Attorney, Agent, or Firm*—Herbert M. Hanegan; Robert S. Linne; Michael C. Smith

[57] ABSTRACT

In a continuous casting plant of the wheel and belt type, the grooved casting wheel 11, and the associated belt or band 12, are tilted laterally so that the plane of rotation is inclined. As a result, the cast bar 30 emerges from the casting wheel without any horizontal surface, and passes to bar preparation machinery with this orientation, prior to being rolled.

28 Claims, 4 Drawing Figures

INCLINED WHEEL AND BELT CASTING MACHINE

TECHNICAL FIELD

This invention relates generally to continuous metal casting and rolling systems and more particularly to an inclined wheel and belt casting machine and method for operation thereof.

BACKGROUND ART

Wheel and belt type continuous casting machines are well known in the art. Examples are disclosed in U.S. Pat. Nos. 3,315,349, 3,349,471, 3,561,105, 3,716,423 and 3,672,430. All of these continuous metal casting systems have two things in common. First, the wheel and belt revolve in a single vertical casting plane. This requires the entire casting facility to be designed around vertical alignment of the casting wheel and normally includes complex building requirements such as multiple story buildings and/or deep pits to house the bottom of the casting wheel and coolant drains. Second, the casting groove or mold is in the outer periphery of the wheel, and cooperates with a flexible belt to form the casting mold.

Although inclined casting wheels are discussed in U.S. Pat. No. 437,509 and German Pat. No. DT 113,573, casting wheels are normally aligned substantially vertical or substantially horizontal. This double wheel eccentric/inclined band manufacturing system (U.S. Pat. No. 437,509; DT No. 113,573) is disclosed herein because of its inclined wheel; however, since the present invention is specifically a wheel and belt type casting and rolling system having a mold formed by a peripheral groove of a wheel cooperating with a band, the inclined/eccentric double wheel system (U.S. Pat. No. 437,509; DT No. 113,573) as well as the horizontal casting wheel system with a casting groove on the top horizontal surface (U.S. Pat. No. 359,349; U.S. Pat. No. 3,284,859 discussed hereinafter) are considered outside the field of the present wheel and belt type invention.

Another type of casting wheel is disclosed in U.S. Pat. Nos. 359,349 and 3,284,859 wherein the wheel is substantially horizontally aligned and the casting groove is on the top horizontal surface near the outer periphery.

Although the peripheral groove type vertical wheel and belt casting and rolling system is preferred because there is more control over the cast product, there are several disadvantages in the vertically aligned type of wheel and belt casting and rolling system.

These disadvantages include high molten metal head pressure against the belt which sometimes causes leakage between the belt and the peripheral groove. Also, the cast bar normally has a broad and flat horizontal top which travels through the bar preparation machinery and tends to provide a surface for collecting debris which can be rolled into the bar and can cause defective rod and broken wire. In addition, since the bar travels directly over the open casting pool, slag and other debris from the bar or its conveyor frequently falls into the casting pool resulting in major defects in the finished rod. Vertically aligned casting wheels also require that all the associated equipment function within narrow vertical alignment limitations which usually results in unnecessarily complex cooling apparatus, metal pouring apparatus and drive mechanisms. Further, since vertical wheel casting machines are normally cantilevered from the drive mechanism, there is usually a high bending stress in the axle upon which the massive vertical wheel is mounted. For these and other reasons the present inclined wheel and belt casting machine was invented.

DISCLOSURE OF INVENTION

It is therefore a primary object of this invention to provide an improved wheel and belt casting and rolling system wherein the casting wheel and belt is inclined at an optimum angle from the vertical. That is, the wheel and belt revolve in a non-vertical, non-horizontal casting plane. This casting plane is preferably inclined at about 40 to 50 angular degrees from horizontal which is about 50 to 40 degrees from vertical.

Another object of this invention is to reduce the molten metal's head pressure against the band of the wheel and belt type casting machine in order to reduce leakage between the band and the wheel.

Another object is to provide a continuous casting, bar preparation and rolling system wherein the cast bar has no horizontal top to collect debris.

Another object is to eliminate passage of the cast bar directly over the molten metal pool in order to eliminate the problem of scale and/or other debris falling from the cast bar or its conveyor into the molten metal pool.

Still another object is to provide a wheel and belt type casting system wherein the molten metal pouring apparatus is offset from the casting plane.

Another object is to provide a continuous casting system wherein the cooling apparatus is offset from the casting plane.

Still other objects are to provide a more accessible casting wheel, to provide a casting wheel which is relatively easy to install, and to decrease the vertical height requirements such as a large wheel pit and/or multiple story buildings.

Yet another object is to provide less difficult retrofitting of large diameter casting wheels to existing casting, bar preparation and rolling systems wherein the vertical spaces within an existing building need not be altered.

Another object is to provide a wheel and belt type casting system wherein stress in the wheel is decreased and stress on the wheel mounting axle is decreased.

Another object is to promote turbulence of the molten metal as it enters the mold by allowing swirl of the molten metal (or anti-swirl) in order to inhibit the growth of large dendrites in the molten metal.

Another object is to provide better heat transfer from molten metal at the base of the casting groove by pouring the molten metal against the groove base while promoting turbulence in the pool.

BRIEF DESCRIPTION OF THE DRAWINGS

While the specification concludes with claims particularly pointing out and distinctly claiming the subject matter which is regarded as the invention, it is believed that the invention, objects, features and advantages thereof will be better understood from the following description taken in connection with the accompanied drawings in which like parts are given like identification numerals and wherein:

BEST MODE FOR CARRYING OUT THE INVENTION

Figure 1:
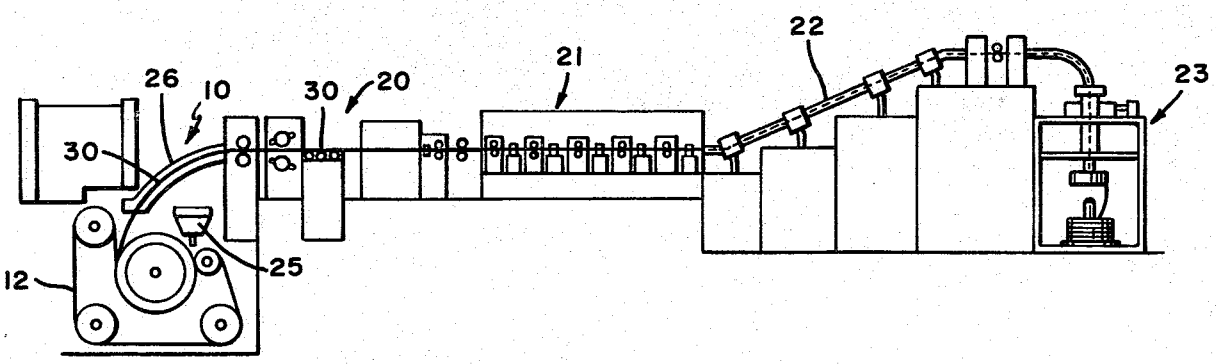
FIG. 1 is a schematic elevation view of a conventional wheel and belt type continuous casting and rolling system.

As FIG. 1 illustrates, a conventional wheel and belt type continuous casting system includes a casting machine 10, bar preparation machinery 20, a rolling mill 21, surface treatment means 22, and a coiler 23. Molten metal is poured from a pouring pot 25 into the casting machine 10 and is solidified into bar 30. The bar 30 advances in a circular manner around the casting machine 10, is extracted therefrom, and is guided up and toward the rolling 21 mill for further processing. Since the wheel and belt casting machine 10 has a vertical casting plane, the bar 30 advances directly over and above the pouring pot 25. Often solidified debris such as scale falls from the bar 30 or from bar conveyor means 26 into the molten metal pouring pot 25 which pours the debris into the casting machine 10 resulting in defective bar 30. The bar 30 advances into bar preparation machinery 20 which is designed to trim, brush, scrape and shear irregularities from the surface of the bar 30. Since the casting machine 10 is vertically oriented, the casting bar 30 is formed with a horizontal top surface which tends to collect debris from the bar preparation process which should be removed, usually by brushing. As the bar advances through the rolling mill 21 any debris remaining on the surface will be rolled into the hot metal surface causing defective rod.

Figure 2:
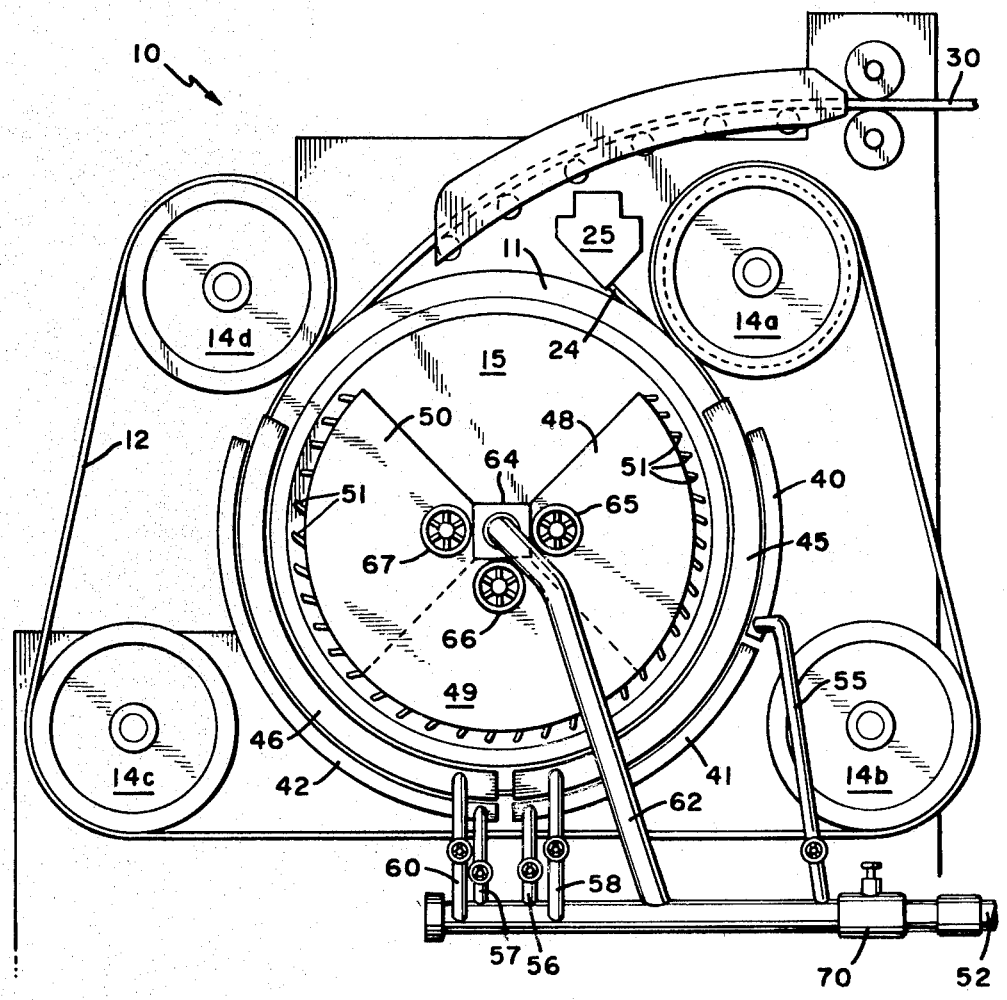
FIG. 2 is a more detailed elevation view of a conventional wheel and belt type casting machine.

FIG. 2 shows a conventional wheel/belt casting machine 10 for the continuous casting of metal with some parts eliminated for clarity as they are generally well known in the art. casting machine 10 includes a rotatable capitalized wheel 11, an endless flexible metallic band 12, and band positioning rollers **14*a*, 14*b*, 14*c*, 14*d* which position and guide the band 12 about a portion of the casting wheel 11. The casting wheel 11 is removably affixed to rotatable support plate 15 which in turn is adapted to be driven by a variable-speed motor (not shown) so as to rotate the assembly in a clockwise direction. The casting wheel 11 has an outwardly facing annular peripheral groove which is closed by band 12 to form an arcuate mold cavity which extends about the lower portion of casting wheel 11. The first band positioning roller 14*a*, which is hereinafter called the presser wheel, functions to position the band 12 against the casting wheel 11 so as to tightly seal this portion of the peripheral groove which is to receive the molten metal. The last band positioning roller 14*d*, which is hereinafter called the tension wheel, is movable in a vertical direction and functions to tension band 12 against the lower portion of the casting wheel 11. There are usually two or more other band positioning rollers 14*b* and 14*c* which are often called idler wheels and which function merely to guide the band 12 along its path from the tension wheel 14*d* back to the presser wheel 14*a***.

During use, the band 12 frictionally engages the casting wheel 11 so that as casting wheel 11 is rotated by its support plate 15, the band 12 is urged along its path at the same speed. Thus a moving mold cavity is formed within the lower portion of the casting wheel. Molten metal is supplied to the moving mold cavity from a furnace (not shown) through a pouring pot 25 and pouring spout 24. The rate of flow of molten metal from the pouring spout 24 is regulated by suitable means so that the level of the molten metal pool remains just below the point at which the presser wheel **14*a* seals the band 12 against the peripheral groove in the casting wheel 11. As casting wheel 11 is rotated, the molten metal is carried along its arcuate path within the moving mold where it is eventually solidified by the cooling system and subsequently extracted as a cast bar for further processing. The cooling system comprises a multitude of liquid spraying nozzles 51 which direct a coolant, such as water, against the surfaces of the casting wheel 11 and the band 12** so as to extract heat therefrom thus also extracting heat from the metal within the moving mold.

Some of the spray nozzles 51 communicate with casting wheel internal manifolds 48, 49, 50 while others communicate with band manifolds 40, 41, 42 and still others communicate with pairs of wheel side manifolds 45, 46. Casting wheel manifolds 48, 49, 50 are positioned adjacent the rotatable support plate 15 and generally in the same plane as casting wheel 11. Each of the manifolds 48, 49, 50 extend through an arc of about 90° along the interior of casting wheel 11 starting near the presser wheel **14*a*, thence along the lower portion of the casting wheel, and extending up towards the tension wheel 14*d*. Thus these manifolds 48–50 supply coolant to three successive groups, or zones, of spray nozzles 51. Similarly, the band manifolds 40, 41, 42 are positioned along an arcuate path adjacent to the band 12 starting near the presser wheel 14*f* and extending in a downward direction around the lower portion of the casting wheel up to a point near the tension wheel 14*d*. A pair of wheel side manifolds 45 is positioned on opposite sides of the arcuate mold and extend from about the entrance of the mold down toward the bottom portion of the casting wheel 11 while another pair of side manifolds 46 extend from the bottom of the casting wheel 11 up towards the exit of the mold. Thus it should be apparent that these various manifolds, each of which supply coolant to groups of spraying nozzles 51**, allow the precise control of the cooling rate of the cast bar within the moving mold.

As shown in FIG. 2, the liquid coolant, such as water, is supplied to the manifolds of casting machine 10 by means of main supply pipe 52. A plurality of branch conduits extend from the main supply pipe 52 and communicate with the various manifolds as follows: conduit 55 supplies coolant to the upper band manifold 40, conduit 56 supplies coolant to the lower band manifold 41 and conduit 57 supplies coolant to the remaining rear band manifold 42. Branch conduit 58 supplies coolant to the front pair of side manifolds 45 while conduit 60 supplies coolant to the rear pair of side manifolds 46. Each of the aforementioned branch conduits includes a control valve which functions to regulate the flow of coolant from main supply pipe 52 to the various manifolds 48–50. Valve assembly 64 includes three control valves 65, 66, 67 which function to control the flow of coolant from branch conduit 62 into each of the interior wheel manifolds 47, 49, 50 respectively. Preferably a main control valve 70 is positioned in main supply pipe 52 and is electrically or pneumatically actuated so as to initiate the flow of coolant into the branch conduits when casting is begun. The coolant flows by gravity to a machine drain (not shown) located in a casting machine pit similar to item 16 of FIG. 3 and is circulated to a reservoir for reuse.

Figure 3:
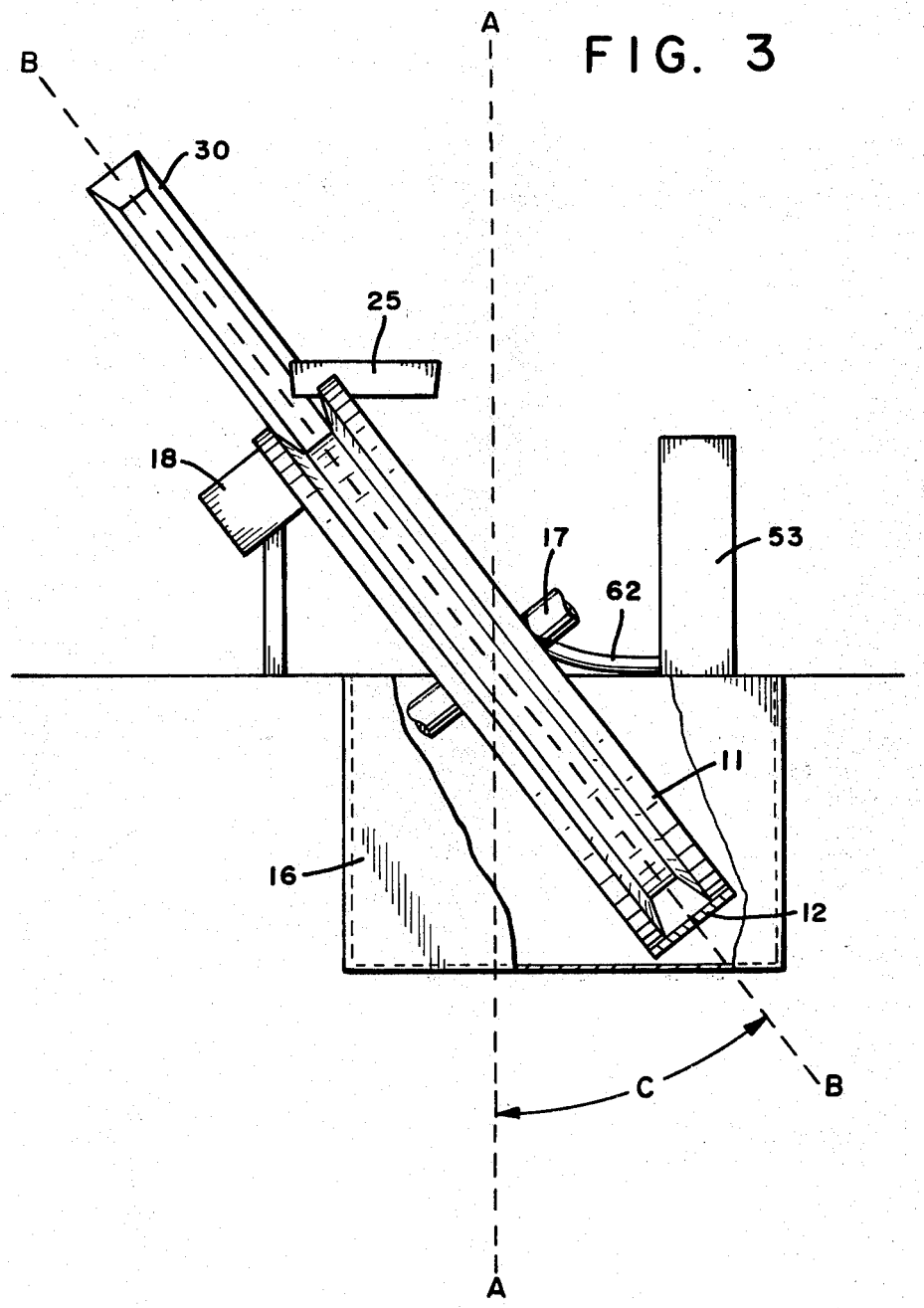
FIG. 3 is an up stream end view of portions of the inclined wheel and belt system of the present invention.

The present invention is illustrated by FIG. 3, which shows the casting wheel 11 and the casting band 12 inclined along line B—B at angle C from the vertical plane, as represented by line A—A. While any substantial incline is better than vertical or horizontal alignment, it is preferred that angle C be from about 20 degrees to about 70 degrees. The most preferred incline is at an angle C of about 45 degrees (as shown). The lower portion of the wheel 11 extends down into pit 16 which is relatively shallow and the upper portion of the wheel 11 extends to a relatively low height, which decreases plant/installation and retrofit expenses and makes the wheel 11 and belt 12 more accessible for repair or replacement.

As the bar 30 advances upward toward further processing from this inclined wheel system, the bar 30 passes pouring pot 25 above but remote therefrom, thereby avoiding the problem of debris falling from bar 30 or conveyor means 26 of FIG. 1 into pour pot 25. The top surface of bar 30 is presented to bar preparation machinery 30 of FIG. 1 in an inclined rather than horizontal alignment which promotes gravitational removal of debris, rather than providing a flat surface which tends to collect debris, thus reducing the possibility of rolling debris into the rod surface and eliminating the brushing step of the prior art.

This inclined wheel system also reduces molten metal head pressure against band 12 which also reduces leakage between band 12 and wheel 11 and the formation of fins at the bar 30 corners. The conventional casting wheel 11 is now typically 8 feet in diameter with newer machines having wheels 10 feet or more in diameter. Larger wheels are desired in order to improve the quality and quantity of cast bar produced but there are disadvantages because of the increased metalostatic pressure at the bottom of the wheel-mold. For example, the vertical distance from the pouring point to the bottom of the wheel is typically about $\frac{3}{4}$ the diameter of the wheel. Thus molten metal at the bottom of an 8 ft. casting wheel has a vertical pressure head of about 6 ft. When the molten metal being cast is copper, the pressure (in psi) has been calculated to be about 3.767 times the head in inches, or about 270 psi. Whereas at the bottom of a 12 ft wheel, the pressure is about 405 psi. Even though the molten metal at the bottom of the wheel is usually surrounded by a shell of solidified metal, the shell is thin and fragile. The increased pressure associated with larger sized wheels can easily rupture this shell of just-solidified metal unless the vertical head depth is reduced by inclining the wheel. By inclining the wheel to 20 degrees from vertical, pressure at the bottom of the mold is decreased by about 5.5 percent such that pressure with an 8 ft. wheel will be reduced to about 255 psi and pressure with a 12 ft. wheel will be reduced to about 382.5 psi. By inclining the wheel to 45 degrees from vertical, pressure at the bottom of the mold is decreased by about 29 percent such that pressure with an 8 ft. wheel will be reduced to about 192 psi and pressure with a 12 ft. mold will be reduced to about 288 psi. By inclining the wheel to 70 degrees from vertical, the pressure at the bottom of the mold is decreased by about 66 percent such that pressure with an 8 ft. wheel will be reduced to about 93 psi and pressure with a 12 ft. wheel will be reduced to about 139 psi. Resulting pressure may be calculated by the formula: Resulting pressure=(Wheel in inches$\times$0.75$\times$3.767)(Cos of angle). From these claculations it is clear that the pressure with a 12 ft. wheel can be reduced to that of an 8 ft. wheel by inclining the 12 ft. wheel about 45 degrees from vertical.

As FIG. 3 illustrates, coolant supply means 62, 53 are offset from the casting plane represented by line B—B which removes vertical casting plane design restrictions and allows utilization of less complex cooling means 62, 53. The pouring pot 25 and associated molten metal transfer means such as the spout 24 of FIG. 2 are also offset from line B—B and therefore also may be designed without the vertical casting plane limitations. For example, the metal pouring means may direct molten metal against the base of the peripheral groove of the wheel to promote turbulence of the molten metal and to initiate greater heat transfer toward the center of the casting wheel. Controlled tubulence is desired for numerous metallurgical reasons. Existence of additional vertical space immediately above and adjacent to the top of the wheel 11 allows great design leaway for the pouring means, allows great flexibility for positioning and adjustment of pouring means, and allows substitution of the conventional spout in favor of a level pour system.

The casting wheel 11 may be mounted in an inclined cantilevered manner or may be mounted on an axle 17 supported on both ends. Lateral support means 18 may also be used such as a rotatable roller 18 mounted adjacent to the wheel on an axis parallel with line B—B. In both cases stress in the wheel mounting axle 17 is lowered and stress in the wheel is decreased.

The inclined system promotes turbulent pouring of the molten metal into the mold by providing inclined surfaces against which the molten metal may be directed. In addition, the molten metal may be directed toward the base of the casting groove in order promote heat transfer from the metal to the wheel 11. Level pouring of the molten metal may also be achieved while maintaining some degree of turbulence. While turbulent pouring is metallurgically advantageous in many applications such as the casting of high impurity copper, if turbulence need be restricted such as in the casting of clad metal, the pouring means be simply adjusted to counter to turbulence propensity of the inclined casting system. Thus greater degrees of turbulent pouring are achieved while maintaining the flexibility to pour without turbulence by providing the inclined system with adjustable and various metal pouring means. Such flexibility is relatively simple since the pouring means alignment is much easier to adjust than the entire casting machine alignment.

Figure 4:
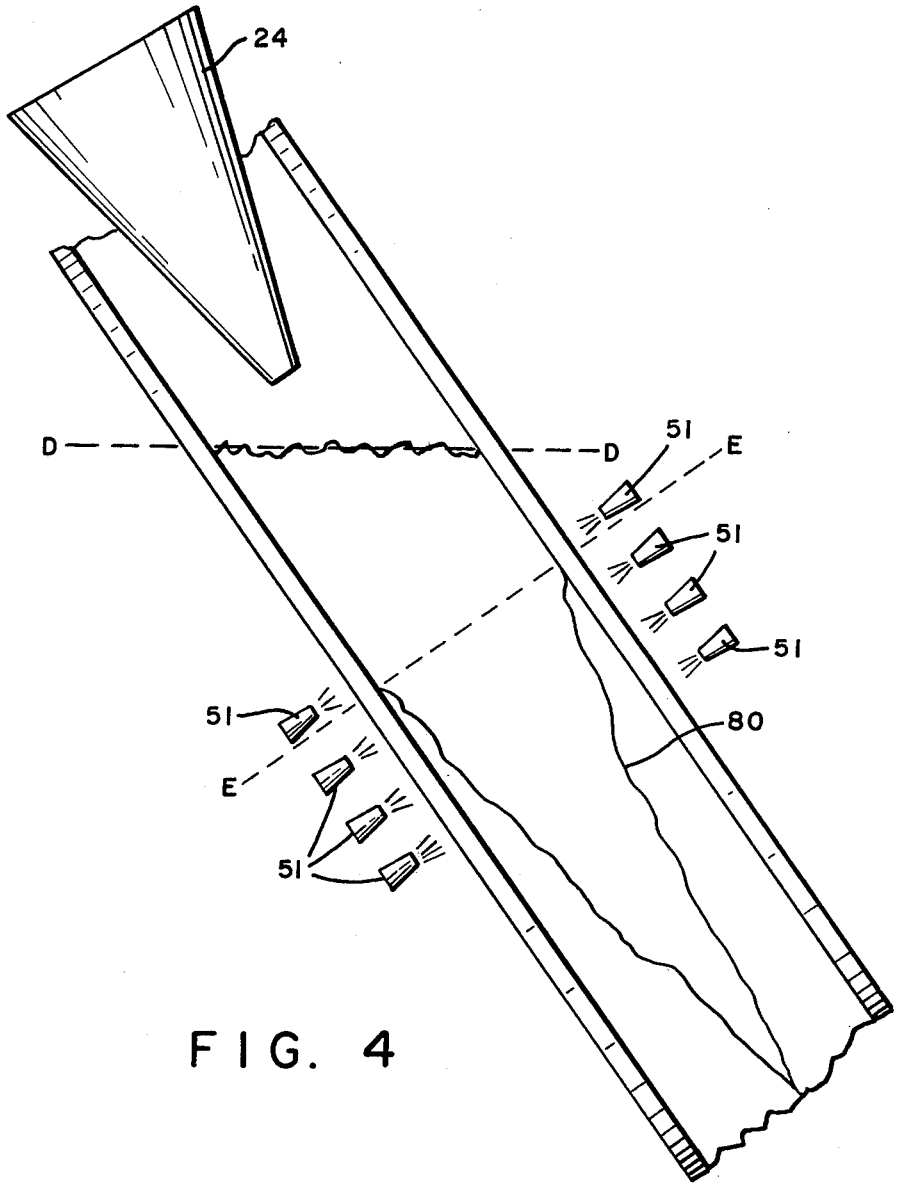
FIG. 4 is a view of portions of the casting wheel and pouring spout.

Some casting operations achieve higher quality product when the metal is substantially uniformly cooled along a cross section of the bar which is perpendicular to the longitudinal axis of the bar. It is believed in the art that formation of a molten metal maniscus substantially perpendicular to the longitudinal axis of the bar is required for such uniform cooling. As FIG. 4 illustrates, the inclined casting wheel 11 will tend to cause the molten metal to seek a maniscus level substantially along line D—D, that is horizontal, but not perpendicular to the longitudinal axis of the mold. However, because solidification does not occur in the first few inches of the molten metal pool, but rather at relatively great distance from the maniscus (depending on cooling rate), the solidified bar is substantially uniformly cooled along a cross section of the bar which is perpendicular to the longitudinal axis of the mold. In fact, since cooling nozzles 51 are positioned in a plane perpendicular to the longitudinal axis of the mold, solidification occurs substantially uniformly along such plane E—E as the solidification front 80 initiates substantially uniformly in plane E—E.

While this invention has been described in detail with particular reference to a preferred embodiment thereof, it will be understood that the variations and modifications can be effective within the sphere and scope of the invention as described hereinbefore and as defined in the appended claims.

INDUSTRIAL APPLICABILITY

This invention is capable of exploitation in the metal forming industry and is particularly useful in a system for the continuous casting of molten metal by a wheel and belt type casting machine.

We claim:

1. Improved apparatus for the continuous casting of molten metals to form a cast bar of the type including all of the following being mounted in a generally vertical casting plane, a rotatable casting wheel having a peripheral groove therein, an endless metallic band adapted to cover a portion of said groove to form an arcuate mold cavity therebetween, and means for cooling said mold cavity at a rate sufficient to at least partially solidify the molten metal cast therein; wherein the improvement comprises a casting wheel inclinable relative to said vertical casting plane so that said casting plane is adjustable to any of several positions inclined away from said vertical casting plane.

2. The apparatus of claim 1 wherein said casting plane is inclined from about 20 angular degrees to about 70 angular degrees from vertical.

3. The apparatus of claim 2 wherein said casting plane is inclined about forty-five angular degrees from vertical.

4. The apparatus of claim 1 further comprising means for promoting uniform cooling substantially peripendicular to the arcuate, longitudinal axis of the mold cavity.

5. The apparatus of claim 1 further comprising cast metal pouring apparatus offset from said casting plane.

6. The apparatus of claim 5 further comprising bar conveyor means offset from said metal pouring means such that said conveyor and said bar do not pass directly over molten metal pouring means.

7. The apparatus of claim 1 further comprising lateral support means for positioning said casting wheel in the inclined plane.

8. The apparatus of claim 1 wherein said inclinable casting wheel comprises a means for reducing metallostatic pressure at the bottom of said arcuate mold.

9. The apparatus of claim 8 wherein said inclinable casting wheel comprises a means for decreasing molten metal leakage between said peripheral groove and said band.

10. The apparatus of claim 8 wherein said inclinable casting wheel comprises a means for reducing said pressure by about 5.5 percent when said wheel is inclined at 20 degrees from vertical.

11. The apparatus of claim 8 wherein said inclinable casting wheel comprises a means for reducing said pressure by about 29 percent when said wheel is inclined at 45 degrees from vertical.

12. The apparatus of claim 8 wherein said inclinable casting wheel comprises a means for reducing said pressure by about 66 percent when said wheel is inclined at 70 degrees from vertical.

13. Improved apparatus for the continuous casting, preparing and rolling metals of the type including a rotatable casting wheel having a peripheral groove therein, an endless metallic band adapted to cover a portion of said groove to form an arcuate mold cavity therebetween, means for cooling said cavity at a rate sufficient to at least partially solidify the molten metal cast therein to cast bar, means for extracting said cast metal bar from said peripheral groove and conveying said cast metal bar to further processing, means for preparing said bar for rolling by removing surface irregularities and debris, and means for rolling said bar into rod; wherein the improvement comprises means for presenting said cast bar to said bar preparation means in inclined alignment such that the top surface of said bar is other than horizontal.

14. The apparatus of claim 13 wherein said means for presenting said cast bar to said bar preparation means in inclined alignment such that the top surface of said bar is other than horizontal comprises a means for reducing surface defects in rod rolled from said bar.

15. An improved method for the continuous casting of molten metals to form a cast bar of the type wherein molten metal is poured into an arcuate mold cavity formed by a rotatable casting wheel hving peripheral groove therein and an endless metallic band adapted to cover a portion of said groove, comprising the step of inclining the casting wheel away from vertical so that it rotates in an inclined casting plane.

16. The method of claim 15 further comprising the steps of extracting cast metal from said casting mold while maintaining said cast bar in said inclined casting plane, advancing said cast bar to further processing without passing said cast bar directly above the molten metal casting apparatus, and presenting said cast bar to bar preparation means, said cast bar having no horizontal top surface for collecting debris.

17. The method of claim 15 further comprising the step of reducing molten metal head pressure against said casting band by inclining the rotatable casting wheel between 20 and 70 degrees from vertical.

18. The method of claim 17 further comprising the step of reducing said pressure by about 5.5 percent by inclining said wheel to 20 degrees from vertical.

19. The method of claim 17 further comprising the step of reducing said pressure by about 29 percent by inclining said wheel to 45 wheel from vertical.

20. The method of claim 17 further comprising the step of reducing said pressure by about 66 percent by inclining said wheel to 70 degrees from vertical.

21. The method of claim 17 further comprising the step of reducing molten metal leakage between said casting groove and said casting band by inclining the rotatable casting wheel between 40 and 50 degrees from vertical.

22. The method of claim 15 further comprising the step of pouring molten metal against the base of said groove.

23. The method of claim 22 further comprising the step of providing increased heat transfer at said groove base by pouring molten metal against the base of said groove.

24. The method of claim 22 further comprising the step of promoting molten metal turbulence within said mold by pouring molten metal against the base of said groove.

25. The method of claim 15 further comprising the step of providing lateral support for said casting wheel thereby reducing stress on wheel mounting means.

26. The method of claim 15 further comprising the step of presenting a cast bar to the bar preparation means such that the top surface of said bar is not horizontal.

27. The method of claim 26 further comprising the step of reducing surface defects in rod rolled from said bar by eliminating a horizontal top surface as a location for debris to collect.

28. The method of claim 15 further comprising the step of forming a molten metal meniscus substantially non-perpendicular to the arcuate, longitudinal axis of the mold cavity, while cooling said bar substantially uniformly along a cross section perpendicular to the arcuate, longitudinal axis of the mold cavity.

* * * * *